United States Patent [19]

Potter et al.

[11] 4,062,579

[45] Dec. 13, 1977

[54] KNOB ATTACHMENT FOR DOOR LATCH

[75] Inventors: Dennis G. Potter; Hagen Dietrich, both of Delta; Joseph Potschka, Vancouver, all of Canada

[73] Assignee: Norris Industries, Inc., South Gate, Calif.

[21] Appl. No.: 712,897

[22] Filed: Aug. 9, 1976

Related U.S. Application Data

[62] Division of Ser. No. 712,898, Aug. 9, 1976.

[51] Int. Cl.[2] ..... E05B 3/06

[52] U.S. Cl. ..... 292/348; 292/169.15; 292/DIG. 38

[58] Field of Search ..... 292/169.14, 169.15, 292/169.16, 169.17, 169.18, 169.19, 169.21, 169.22, 169.23, 347, 348, 349, 350, 351, 352, 353, 354, 355, 356, 357, 358, 359, DIG. 38, DIG. 53

[56] References Cited

U.S. PATENT DOCUMENTS

| | | | |
|---|---|---|---|
| 325,445 | 9/1885 | Regan | 292/348 |
| 326,920 | 9/1885 | Russell | 292/348 |
| 538,952 | 5/1895 | Donovan | 292/347 |
| 542,048 | 7/1895 | Giese | 292/348 |
| 957,837 | 5/1910 | Berry | 292/348 |
| 1,387,888 | 8/1921 | Holt | 292/353 X |
| 2,741,502 | 4/1956 | Crandell | 292/356 X |
| 2,764,445 | 9/1956 | Cerf | 292/169.21 X |
| 3,232,653 | 2/1966 | Wilson | 292/169.18 |
| 3,580,622 | 5/1971 | Morgan | 292/353 X |

*Primary Examiner*—Roy D. Frazier
*Assistant Examiner*—Thomas J. Holko

[57] ABSTRACT

A door latch makes use of moldable material for most of the individual parts with opposite roses adapted to interlock with each other and be held together with a single screw on the axial center line of the knobs and accessible from the outside. Prior to installation of the latch on the door each knob is subassembled with the corresponding rose by employment of an arcuate shoulder on an inner central portion of the knob which is rotated to a position of engagement with a complementary arcuate shoulder in the rose. Rotation inhibiting detents prevent accidental disassembly until the spindle is mounted in place and the spindle then locks the knob against disassembly as long as the latch remains mounted on the door.

7 Claims, 17 Drawing Figures

KNOB ATTACHMENT FOR DOOR LATCH

This is a division of copending application, Ser. No. 712,898 filed Aug. 9, 1976.

Although there has recently been great stress laid upon the security feature of locks there are sundry types of installations where security is not of primary consequence. Despite the lack of stress on the security feature, locks for such purposes do need to be dependable, namely to open and close when needed, in a reliable fashion, for long periods of use. Some installations also have need for what is commonly known as a privacy lock, namely one which can be locked or blocked on the inside for temporary security but which can be released from the outside, in case of an emergency, by some conventional tool such as a screw driver or ice pick, for example. Installations of the type suggested are often adequately supplied by locks of less costly construction and where installations can be quickly and easily made by persons of no more than modest skill. Areas where such locks are in demand include interior doors of recreation vehicles, campers, trailers, temporary housing, closet doors and the like where a door needs to be shut and held shut but wherein no attempt is made to provide a lock greatly resistant to tampering and unauthorized entry.

With the advent of dependable synthetic plastic resin material there has been a progressive substitution of the plastic resin material for some of the working parts of locks. By proper design more and more of the metallic components of a lock can be dispensed with in favor of plastic components. The fact remains, however, that plastic material does have limitations in that it cannot be made in sections as thin as metallic material and on other occasions falls short of the strength which might be required. Moreover if full advantage is to be taken of the use of plastic material it is important to minimize the number of separate components without sacrificing the number of functions performed by each so that such a lock made substantially of plastic components can be molded of relatively few parts and sold in great quantities therefore at an acceptable price advantage.

It is therefore among the objects of the invention to provide a new and improved substantially all plastic lock which is simple, dependable and relatively inexpensive and which at the same time functions smoothly and with a sufficient degree of security to be a useful locking expedient.

Another object of the invention is to provide new and improved molded lock parts which are capable of being assembled by merely shifting the position of one part relative to the other to provide a rotatable interlock which cannot be disassembled once the lock has been mounted on a door.

Still another object of the invention is to provide a new and improved substantially all plastic lock, outside and inside plate and knob assemblies of which after being first sub-assembled can be attached to each other in place on a door by use of only a single centrally located fastening means.

Still another object of the invention is to provide a new and improved lock wherein substantially all of the components are of plastic material so constructed that there is adequate stability provided for the knobs in their relationship with respect to the rose or mounting assembly and an appropriate interlock between opposite rose and knob sub-assemblies which takes place simultaneously with the mounting of the sub-assemblies on the door.

Still another object of the invention is to provide a new and improved lock of substantially all plastic components wherein the number of components is kept substantially to a minimum by reason of building into the main components as integral parts, those parts which normally have existed as separate independent components.

With these and other objects in view, the invention consists of the construction, arrangement and combination of the various parts of the device, whereby the objects contemplated are attained, as hereinafter set forth, pointed out in the appended claims and illustrated in the accompanying drawings.

Figures 1, 2:
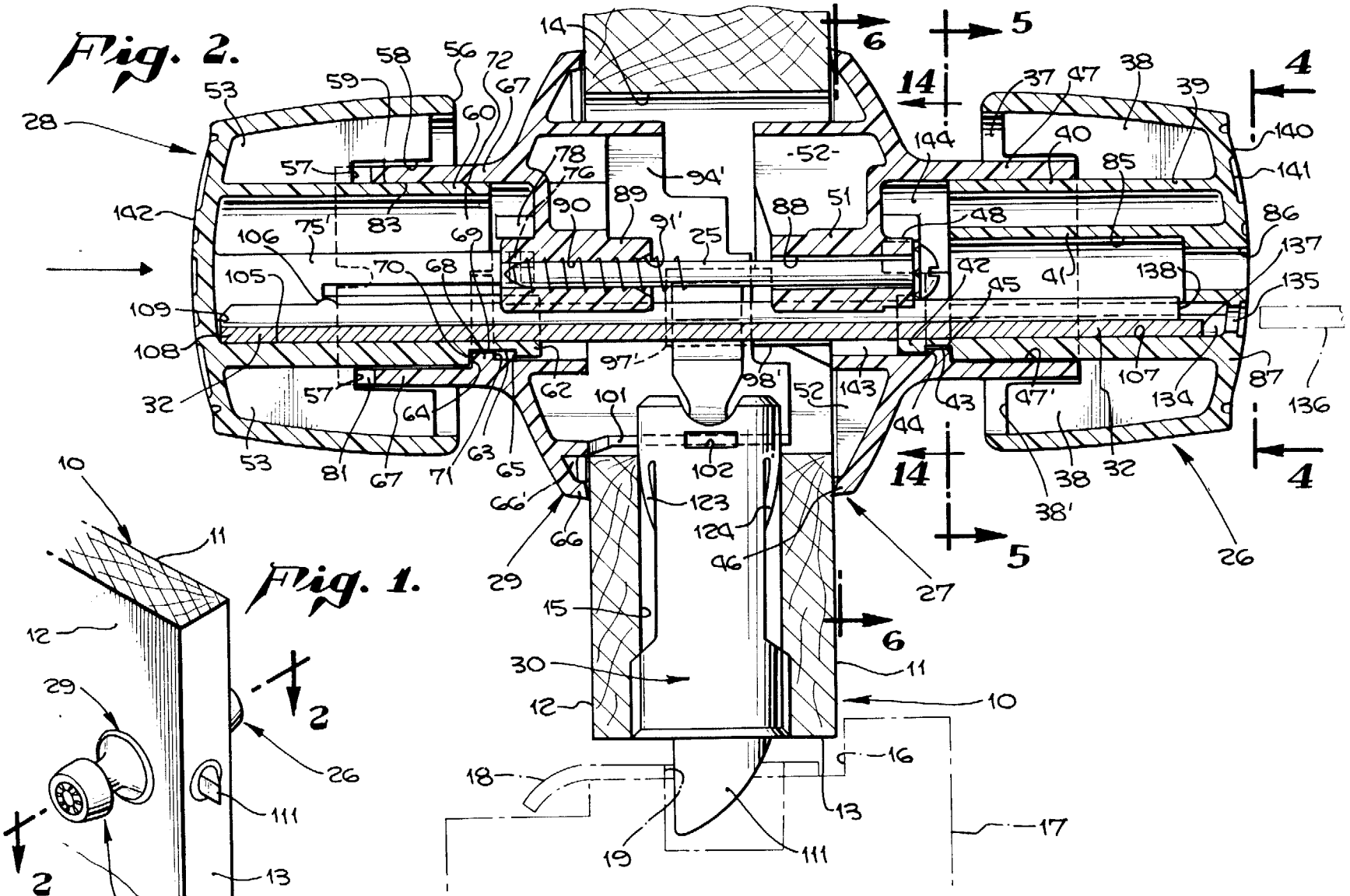
FIG. 1 is a fragmentary perspective view of a section of door showing the plastic privacy lock installed.
FIG. 2 is a longitudinal sectional view on the line 2—2 of FIG. 1.

In an embodiment of the invention chosen for the purpose of illustration, a lock is shown in FIGS. 1 and 2 installed on a door 10 which has an outside face 11, an inside face 12 and a side edge or edge face 13. An opening 14 extends through the door between the outside and inside faces. A bore 15 extends from the edge face 13 into the opening 14. The door 10 is adapted to swing against a door stop 16 in a door frame 17, the frame being provided with a conventional strike plate 18 having the customary latch bolt opening 19 in it. The parts described up to this point are found on virtually all types of doors in which the door lock of the invention is installed.

Figure 3:
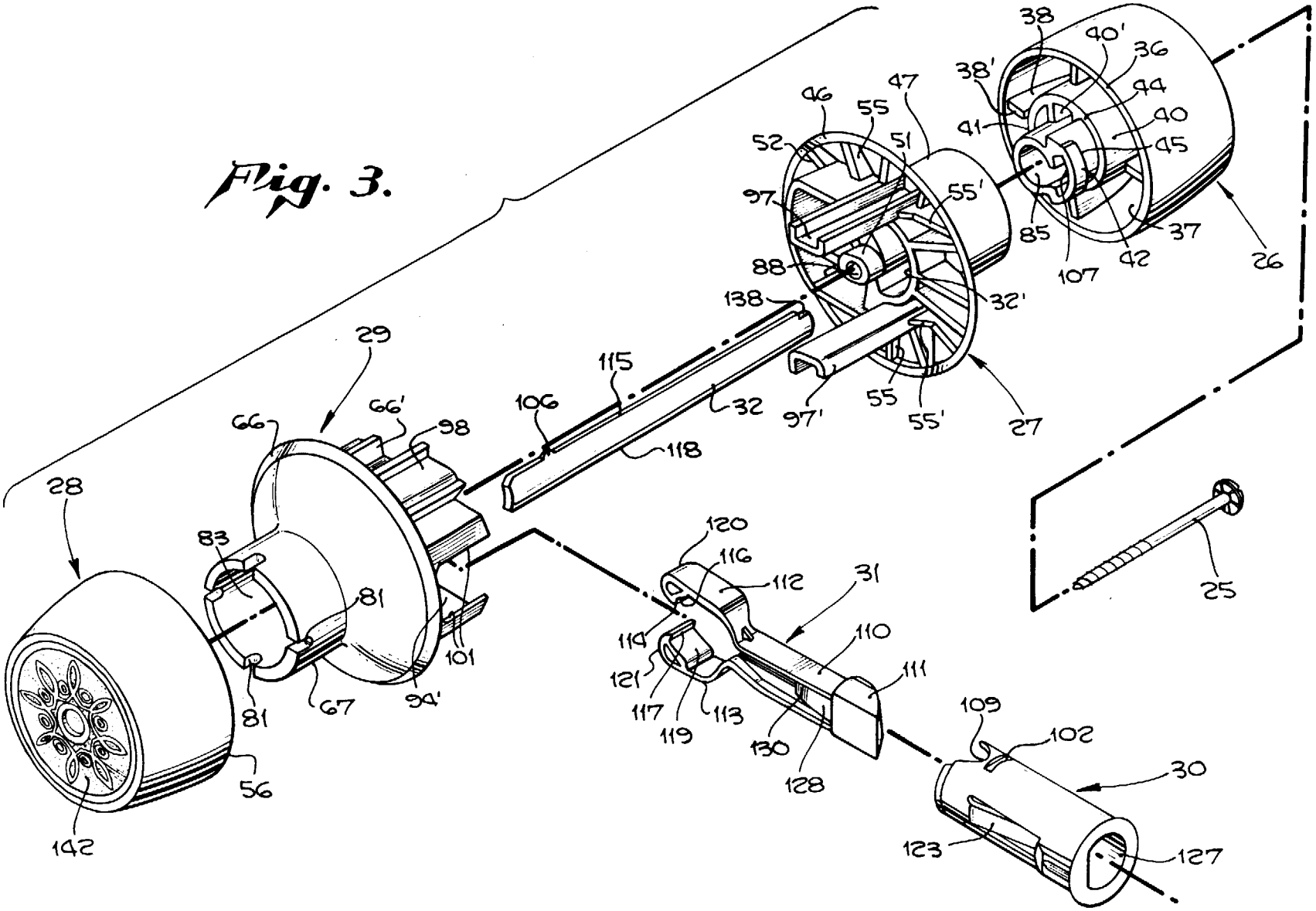
FIG. 3 is an exploded perspective view of all the individual parts.
Figure 5:
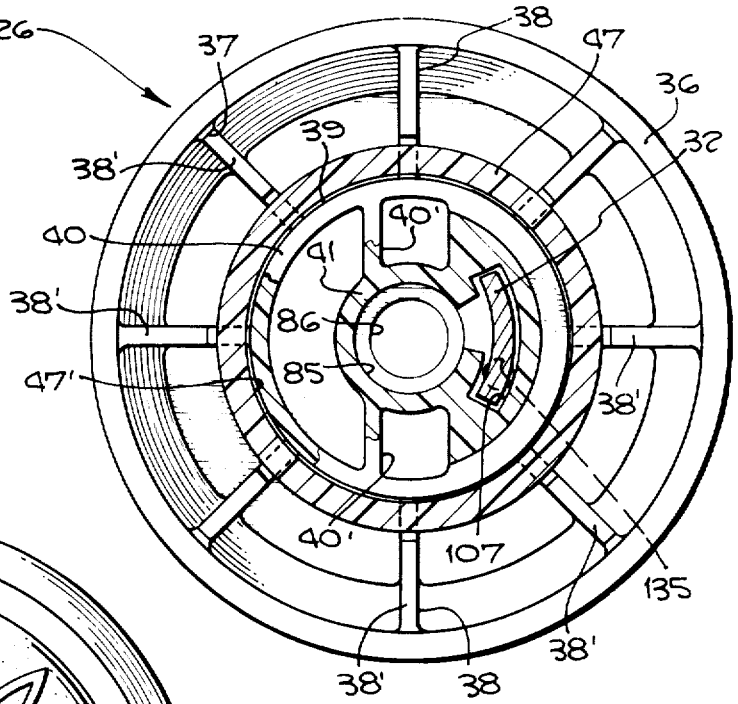
FIG. 5 is a cross-sectional view on the line 5—5 of FIG. 2.

In the embodiment of the invention chosen for illustration there are seven parts for the door latch all of which are individually shown in FIG. 3 together with a conventional mounting screw 25. All parts of the latch are of a synthetic plastic resin material except for the spindle 32 and the mounting screw 25 which, in the present embodiment are of metal. An outside subassembly consists of an outside knob 26 and outside rose or mounting place 27. An inside subassembly consists of an inside knob 28 and inside rose or mounting plate 29. A latch bolt assembly consists of a case 30 and latch bolt 31. All parts of the subassemblies just described are constructed of an appropriate synthetic plastic resin. Cooperating with the outside and inside subassemblies is a spindle 32 which is preferably metal but which can be of an appropriate plastic material.

As shown in FIGS. 2, 3, 4, and 5 the outside knob 26 has an inside end 36 in which is an annular recess 37 formed by inner ends 38' of fins 38 and the wall 39 of a sleeve-like protruberance 40. The protruberance 40 stiffened by fins 40' extends axially inwardly of the inside face 36. Concentrically disposed within the protruberance 40 is an inner sleeve 41, at the inner end of which is an arcuate projection 42 separated from the remainder of the inner sleeve 41 by a recess 43. The recess forms an outwardly facing shoulder 44 and an inwardly facing shoulder 45. By reason of the character of the material and the length of the inner sleeve there is a degree of flexibility.

The outside rose 27 has an annular rim 46 which is pitched inwardly at the outside edge so as to bite slightly into the outside face 11 of the door. Extending axially outwardly from the rim is a bearng sleeve 47 having an inside bearing surface 47'. The bearing sleeve extends into the recess 37 where the wall 39 on the protruberance 40 is adapted to bear as the knob is rotated relative to the rose. A boss 48 is an extension of a centrally disposed mass 51 molded integrally with the rose 27 to which the mass is attached by sundry radially disposed fins 52 and ribs 55, 55'. The mass 51 and portions of the fins 52 project inwardly relative to the outside face 11 of the door. An enlarged arcuate clearance 32' in the outside rose provides room for the spindle to rotate.

Extending inwardly into the inside knob 28 from an inside end 56 is a series of recesses 57 each formed by a wall 58 of a fin 53 and the exterior of a somewhat sleeve-like protruberance 60. Alternate fins 54 are cut deeper. At the inner end of the protruberance 60 is an arcuate projection 62. The projection is separated from the remainder of the protruberance by a relatively wide recess 63 which provides an outwardly facing shoulder 65 and an inwardly facing shoulder 64.

On the inside rose 29 is an annular rim 66 which is adapted to bear against the inside face 12 of the door. The rim may also be pitched slightly inwardly so that its outside edge may bite slightly into the face 12 of the door and ensure contact of the rim structure 66' also with the face of the door. Extending axially outwardly from the inside rose 29 is a bearing sleeve 67 which projects deeply into the recess 57 of the inside knob 28 to a position where it is adapted to bear rotatably against the wall 59. An arcuate boss 68 provides an arcuate surface 69 in a position adapted to bear against the bottom of the recess 63 and also to provide an axially outwardly facing shoulder 70 adapted to engage the inwardly facing shoulder 64 of the knob. An axially inwardly facing shoulder 71 is adapted to engage the outwardly facing shoulder 65 of the inside knob. As will be observed from the drawings, particularly FIGS. 2 and 7, the width of the recess 63 is substantially greater than the width of the boss 68 so that the inside knob 28 can shift axially an appreciable amount.

Figure 8:
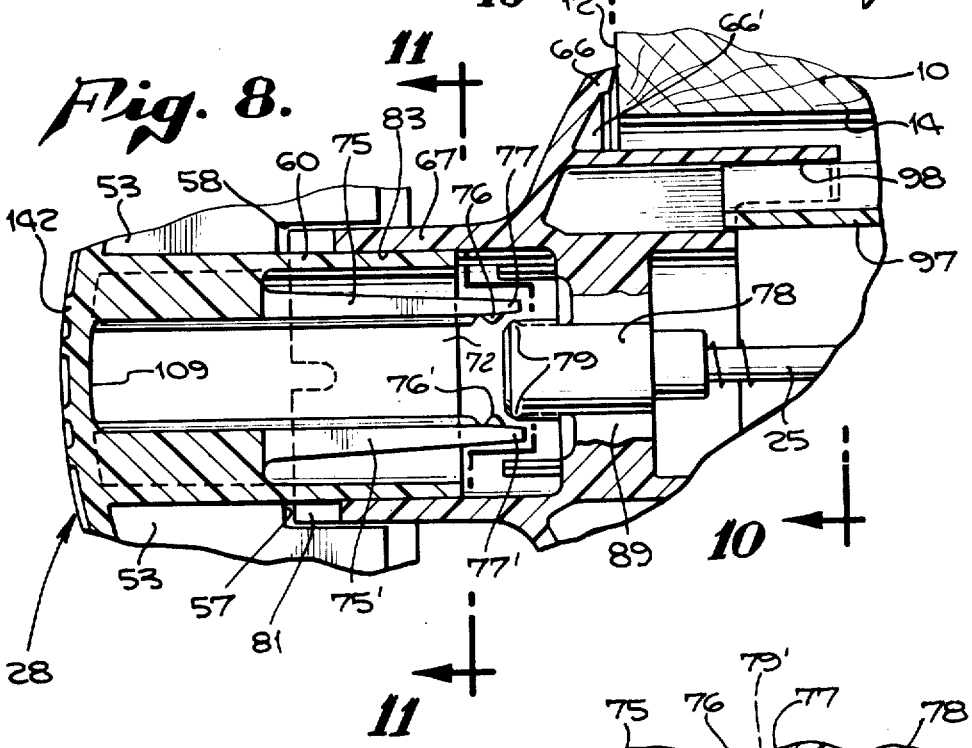
FIG. 8 is a longitudinal sectional view of the inside locking assembly on the line 8—8 of FIG. 7.
Figure 9:
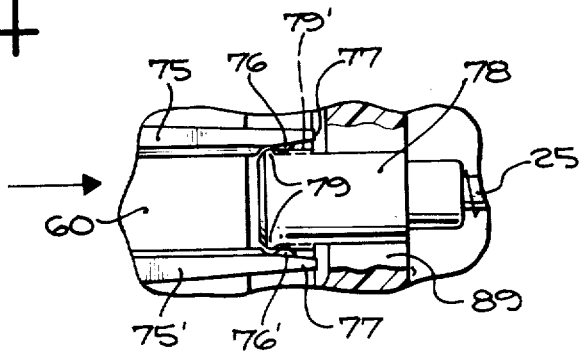
FIG. 9 is a fragmentary longitudinal section view of the inside locking assembly parts in locked position.
Figure 11:
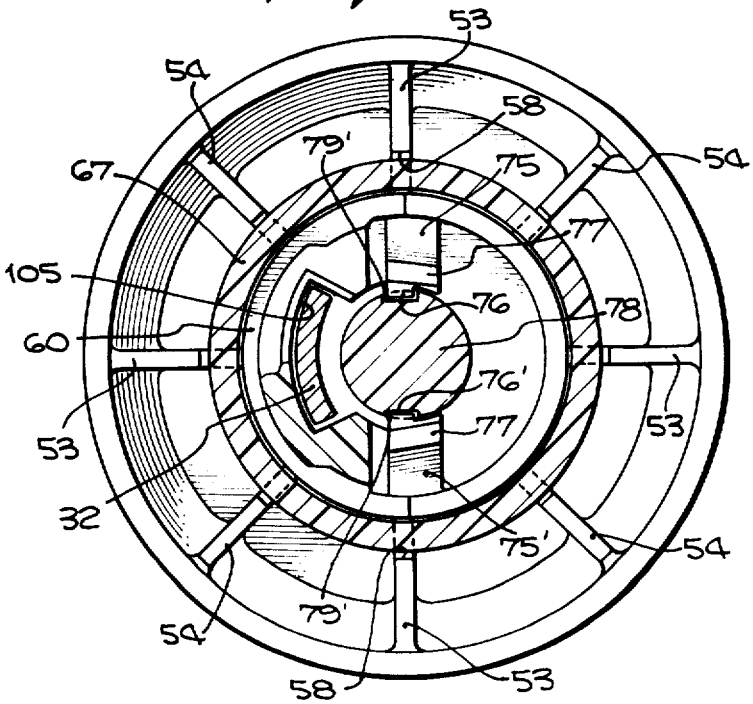
FIG. 11 is a cross-sectional view on the line 11—11 of FIG. 8, but with the knob shifted to locked position.
Figure 12:
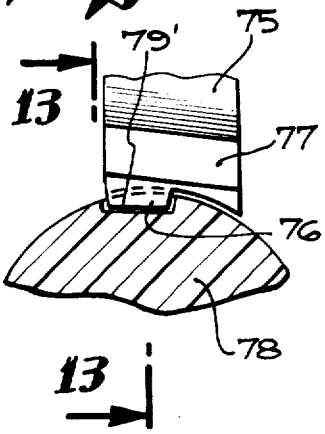
FIG. 12 is a fragmentary enlarged cross-sectional view of the "push-to-lock" form of the device showing the locking detent.
Figure 14:
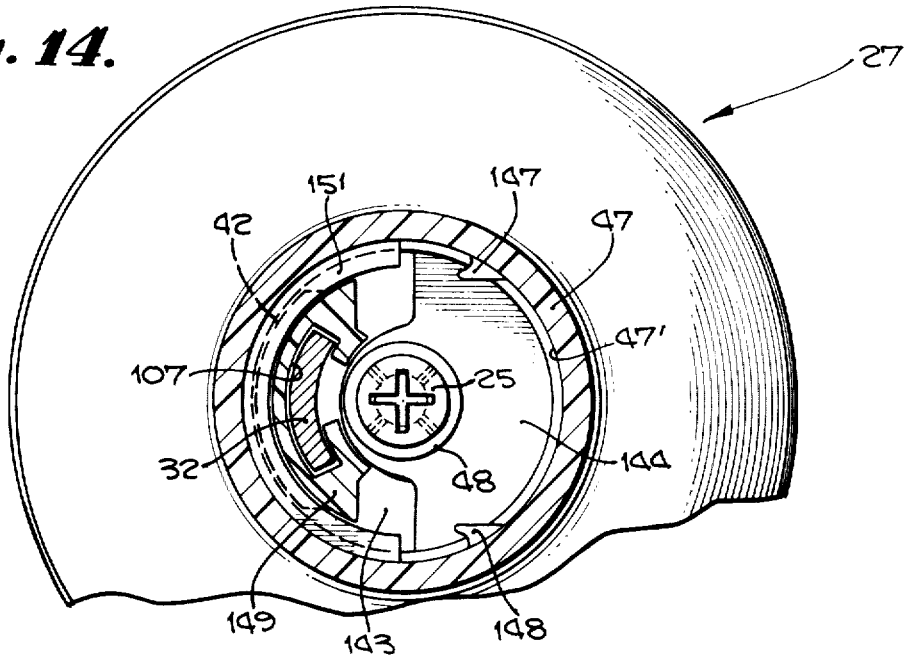
FIG. 14 is a cross-sectional view on the line 14—14 of FIG. 2 showing the knob retention structure.

Also on the inside knob 28 are locking legs 75 and 75' best shown in FIGS. 8, 9, and 11. The locking legs 75 and 75' are resilient and have at their respective inner ends beads 76 and 76' separated axially in one direction from respective ends 77 and 77'. The beads 76 and 76' are adapted to slide over a boss 78 and enter respective channels 79' behind the corresponding locking lugs 79 in an inwardly extended locked position of the inner knob 28, as shown in FIG. 9.

Figure 7:
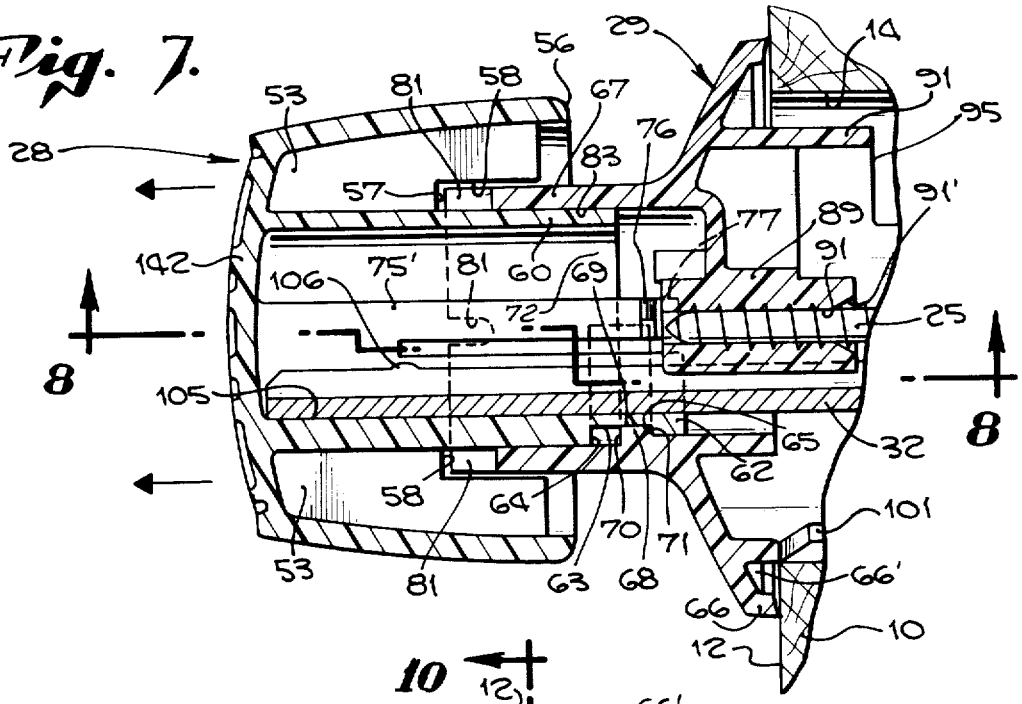
FIG. 7 is a longitudinal sectional view of the inside locking assembly in unlocked position of the push-to-lock form of the device.

To understand the locking arrangement reference is made to FIGS. 3 and 7 of the drawings where there is shown a series of circumferentially spaced axially inwardly extending notches or slots 81 at the edge of the bearing sleeve 67. Those portions of the fins 53 at the bottoms of the recesses 57 of the inside knob are adapted to project into the respective notches 81, when the inner knob 28 is pushed inwardly to the position shown in FIG. 9. By having the sleeve-like protruberance 60 slide snuggly within an interior bore 83 of the bearing sleeve 67 the locking beads 76, 76' are effectively centered with a minimum amount of wear.

The interlocking relationship locks the inner knob against rotation. When the inner knob is projected inwardly from the position of FIG. 8 to the position of FIG. 9, the beads 76 and 76' are flexibly deflected by the locking lugs 79 until they override the locking lugs and are releasably detained in the inwardly extended position, namely, the position in which the respective fins 53 are in the notches 81. In addition the sleeve 60 has a semicircular segment 72, the edges of which align with corresponding edges of the arcuate boss 68 before the fins 53 can enter the notches 81. The breadth of the recess 63 is made such that it will accommodate an axial movement sufficient to accomplish the locking just described.

Conversely when the inner knob is to be unlocked it is merely pulled outwardly during which movement the beads 76 and 76' are again deflected over the locking lug 79 from the position of FIG. 9 to the position of FIG. 8 wherein the fits 53 and segment 72 are disengaged. In the outer position of FIG. 8 the inner knob is still in rotatable engagement with the inside rose 29 by reason of the sliding fit of the protruberance 60 in the bearing sleeve 67.

In unlocked position ends of the fingers beyond the beads 76, 76' overlie the annular locking lug 79 so that when the knob is pushed upon the fingers 75, 75' do not hang up and cause the fingers to buckle.

For anchoring the two roses in position on the door in engagement with each other there is only the single screw 25 already identified. In the outside knob there is a central passageway 85 larger in diameter than the head of the screw to which access is had for a screw driver through a hole 86 in an end wall 87 of the outside knob. The hole 86 is preferably smaller than the head of the screw.

In the mass 51 of the outside rose there is a passageway 88 in axial alignment with the passageway 85 having a diameter large enough to snuggly accommodate the screw. A web or protrusion of material in the passageway 88 (not shown) may be employed to temporarily hold the screw 25 out of engagement with, but in alignment with, a screw hole 90 in a mass 89 of the inside rose 29. A flared opening 91' serves to direct the screw 25 into the hole 89. The screw hole 90 is small enough so that a thread forming screw like the screw 25 can be employed to thread its way into the screw hole 90 to hold the parts together. By making the hole 86 smaller than the head of the screw the screw can not fall out and get lost. The two subassemblies are attached together in this fashion and at the same time the parts are fastened in position on the door.

Figure 10:
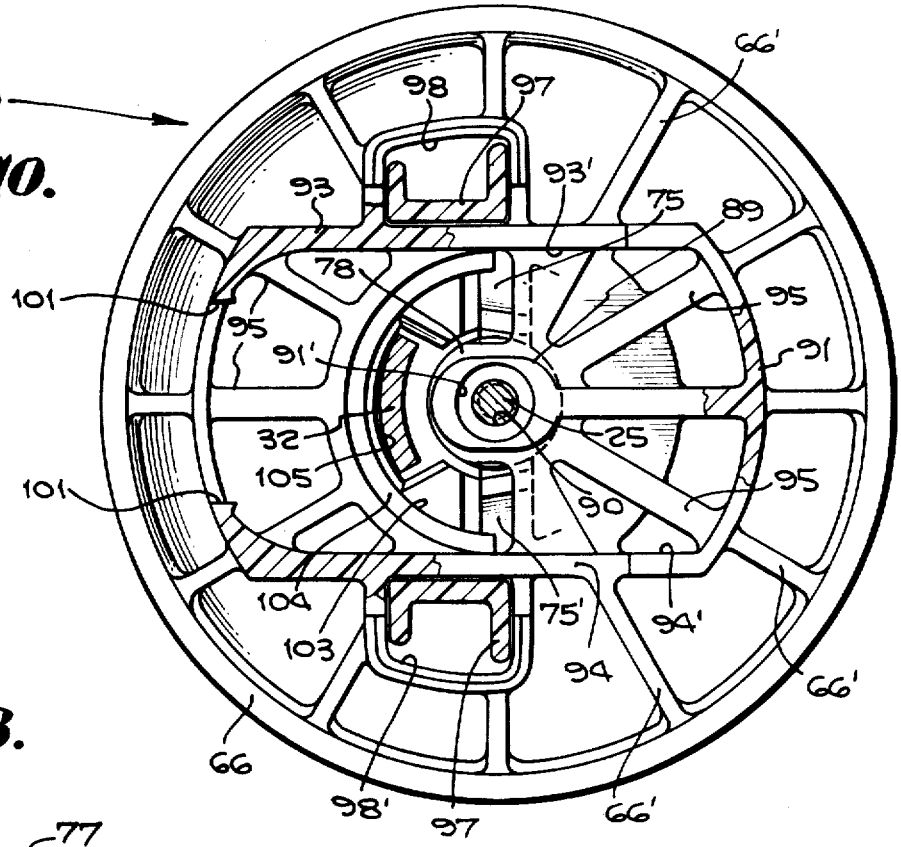
FIG. 10 is a cross-sectional view on the line 10—10 of FIG. 8.
Figure 13:
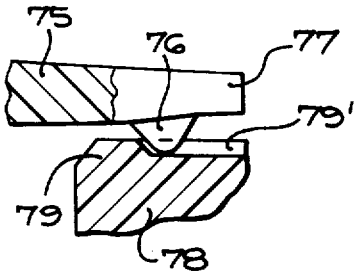
FIG. 13 is a longitudinal sectional view on the line 13—13 of FIG. 12.

There is appreciable reinforcing structure forming part of the inside rose 29 embodied in arcuate walls 91 and 92 and straight walls 93 and 94 as shown advantageously in FIG. 10. Surfaces 93' and 94' on the respective walls 93, 94 slidably accommodate corresponding arms 112 and 113 of the latch bolt 31. Circumferentially spaced radially extending fins 95 interconnect the walls 91, 92, 93, and 94 with the mass 89. Other circumferentially spaced and radially extending fins 66' interconnect the walls 91, 92, 93, and 94 with the rim 66 of the inside rose, as shown in FIG. 10. Edges 101 of the wall 92 engage slots 102 in the latch bolt case 30 to hold parts together.

An arcuately extending space 103 formed in part by a wall section 104 of the inside rose provides for rotation of the spindle 32.

To prevent the inside rose 29 from rotating relative to the outside rose 27 after they have been anchored in position as previously described channel sections 97 and 97'are provided on the outside rose 27 and these are adapted to be received in respective complementary pockets 98 and 98' on the inside rose. Further still to center the inside rose in the opening 14 in the door and by this center the entire assembly, outside surfaces of the pockets 98 and 98'and the arcuate walls 91 and 92 have substantially the same curvature as the opening 14.

To accommodate the spindle 32 there is provided in the inside knob 28 an arcuate pocket 105 which has a cross sectional area and size complementary with respect to the cross sectional area and size of the spindle 32. The spindle is additionally provided with a pair of projections 106 which establish a frictional engagement with the walls of the arcuate pocket so that once the spindle has been pushed into position in the inside knob it will not readily fall out. Similarly the outside knob 26 is provided with an arcuate pocket 107 into which the outside end of the spindle 32 can freely enter. The spindle is of such length that one end 108 bottoms against an end wall 109 of the inside knob. No attempt is made to have the opposite end of the spindle bottom against the end wall 87 of the outside knob 26 because when doors of different thickness are encountered the position of the spingle 32 in the arcuate pocket 107 changes. When the knobs are interconnected by the spindle 32 as described both rotate simultaneously when one or the other is rotated.

In essence rotation of the knobs is for the purpose of withdrawing the latch bolt 31. The latch bolt is specially constructed for this purpose. As shown in FIG. 3 the latch bolt consists of a shaft member 110 at one end of which is a latch bolt head 111 of customary design. The other end of the shaft 110 is bifurcated to provide the pair of resilient arms or bolt tails 112 and 113. The resilient arm 112 has a shoulder 114 facing the spindle 32 at an adjacent edge 115. Adjacent the shoulder 114 is an oblique camway 116 along which the edge 115 of the spindle is adapted to travel. Similarly on the resilient arm 113 is a shoulder 117 adjacent an opposite parallel edge 118 in the spindle 32 with a similar camway 119 along which the edge 118 is adapted to travel. When the spindle is rotated by operation of one or the other of the knobs from extended position to retract position the latch bolt head 111 is withdrawn subject to subsequent extension by appropriate spring action, namely by spring legs 123 pressing against ramps 128 which extend obliquely from an inner end 130 of the ramps.

For unlocking the lockset from the outside of the door, more commonly known as emergency release, there is provided an opening 135 in the end wall 87 of the outside knob 26, the opening being in alignment with the spindle 32. An appropriate tool such, for example, as a rod 136 can be inserted through the opening 135 and pressed against an adjacent end edge 137 of the spindle 32 which in turn pushes against the end wall 109 of the inside knob 28 causing the beads 76 and 76' to be disengaged from the annular lock lugs 79 at which time the fins 53 are disengaged from the notches or slots 81 and the semicircular segment 72 is disengaged from the edges of the boss 68. As a result the inside, and the outside knob 27 as well, are then free to be rotated for withdrawl of the latch bolt. A slot 134 in the inner sleeve 41 serves to guide the rod 136 as it is pushed against the spindle 32 and a step 138 in the end edge of the spindle also helps center the rod 136 in alignment with the spindle.

Figure 4:
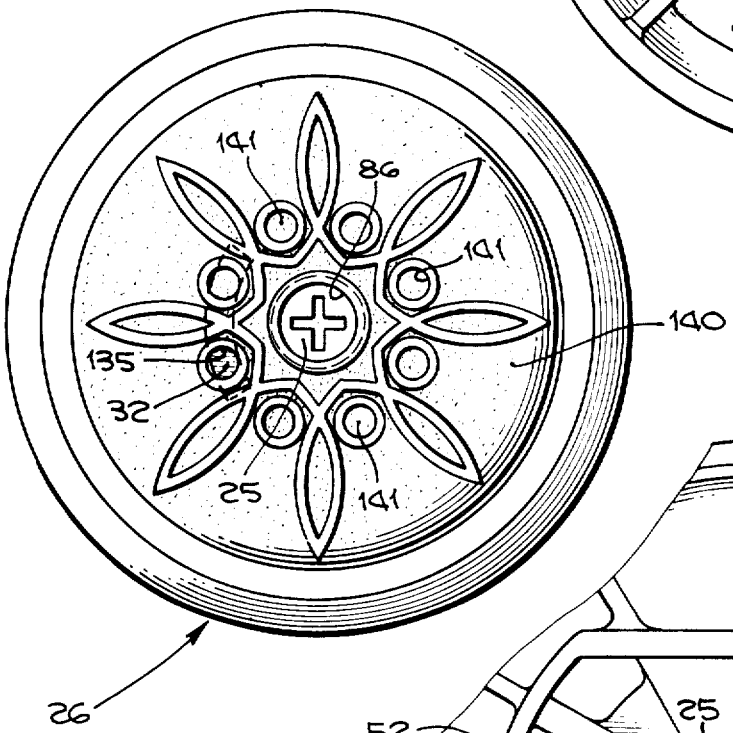
FIG. 4 is a right end elevational view on the line 4—4 of FIG. 2.
Figure 6:
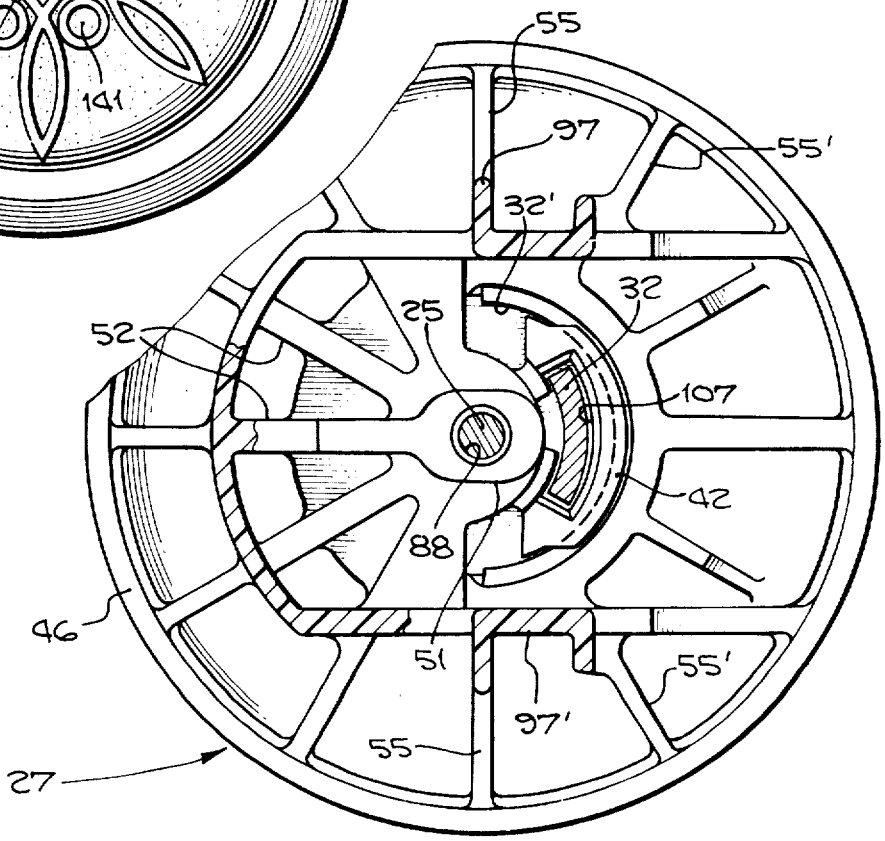
FIG. 6 is a cross-sectional view on the line 6—6 of FIG. 2.

As shown in FIG. 4 an end face 140 of the outside knob 26 can be provided with a design presenting a series of blind recesses 141 which are similar in appearance to the opening 135. Sundry varied designs may be selected. An end face 142 of the inside knob 28 may carry a comparable design.

Prior to assembly of the outside rose and knob with the inside rose and knob on the door the latch bolt is inserted. The spindle then is projected into the space between the resilient arms 112 and 113 of the latch bolt. The case 30 is effectively interlocked with the other working parts and secured in the appropriate rose in the door by interlocking dovetail edges 101 of rose 29 with the dovetail slots 102 of the case 30. It follows, therefore, that all of the component parts are attached to each other and in proper position on the door in a quick, single operation by merely assembling them in position in the door and then securing them by employment of a single screw.

In each instance the knob, whether outside or inside knob, may be preassembled on the corresponding rose in a manner permitting disassembly whenever necessary. For illustrative purposes the structure enabling such preassembly is shown in FIGS. 14, 15, 16, and 17 as applied to the outside knob 26 and outside rose 27, FIG. 14 being taken on the line 14—14 of FIG. 2 with the knob already in—place on the rose and the spindle engaged.

Ultimate assembly results in engagement of the arcuate projection 42 of the knob with an arcuate ledge 145 of the rose. There is a shoulder 150 on one side of the arcuate ledge 145 and on the opposite side a shoulder 151. The arcuate projection 42 forms an arcuate engagement of something less than 180°. Immediately adjacent is an accommodation space 144.

Figure 15:
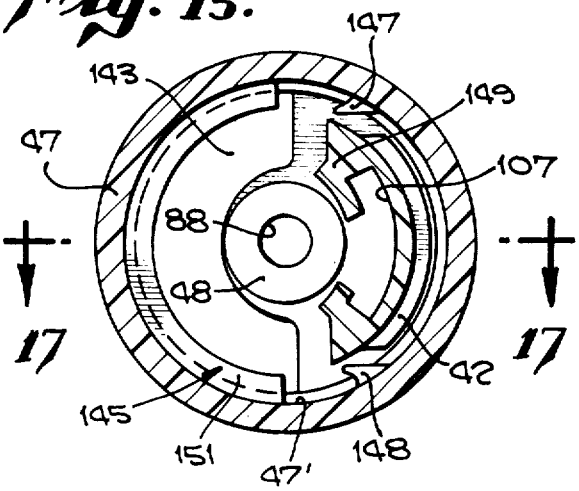
FIG. 15 is a cross-sectional view at the same location as FIG. 14 but with parts in the position occupied prior to sub assembly.
Figure 16:
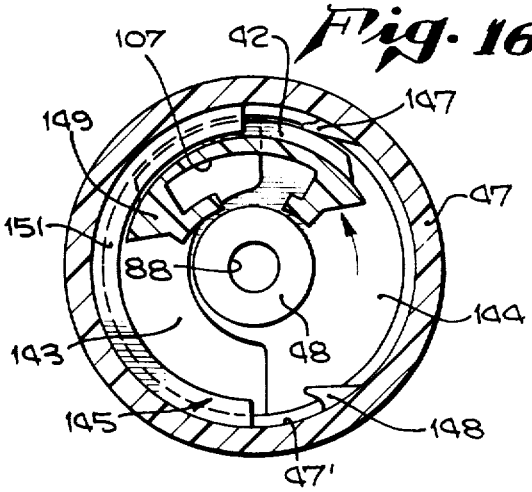
FIG. 16 is a cross-sectional view similar to FIG. 15 showing initial movement to accomplish assembly.
Figure 17:
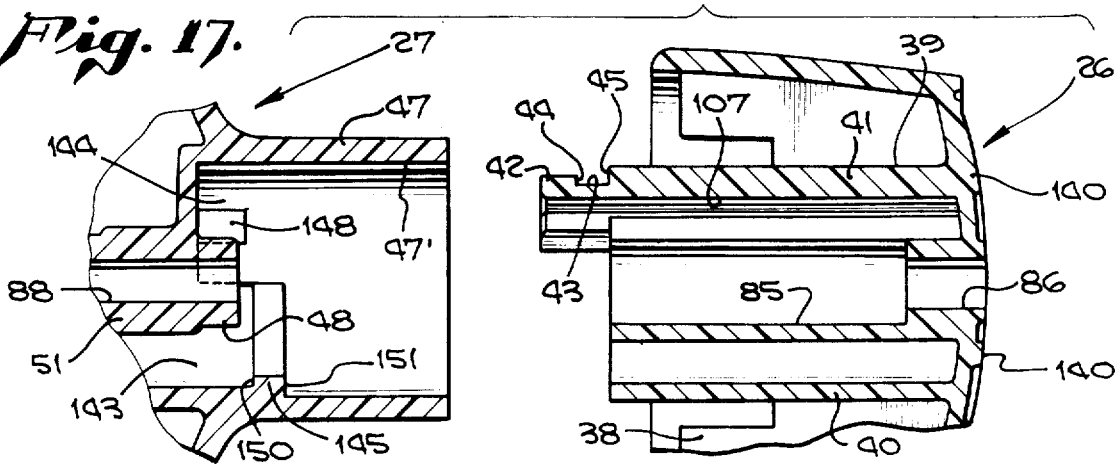
FIG. 17 is an exploded view on the line 17—17 of FIG. 15.

With the parts in the position of FIG. 17 and the spindle removed, the knob is projected into the rose until the projection 42 and its shoulder 44 underly the shoulder 150 of the ledge 145. The rotational arrangement is as shown in FIG. 15 wherein the accommodation space 144 receives the mass 149 of the inner sleeve 41. The knob is then rotated in either direction to the position shown in FIG. 16.

Rotation for example, counterclockwise, causes the projection 42 to be forced against a detent 147. A second detent 148 is provided in case the rotational direction is reversed. The inner sleeve 41, the projection 42 and the detent mutually yield as sleeve 41 is moved to a position under the ledge 145 where a clearance space 143 accommodates the mass 149.

After the projection 42 passes from engagement with the detent the inner sleeve, the projection 42 and the detent resume their initial position, and projection 42 is lodged in rotational engagement with the ledge. Ultimately with the spindle in place as in FIG. 14 the knob cannot be disassembled, due to the spindle prohibiting excess rotation.

Without the spindle in place opposite ends of the projection 42 will abut against one or another of the detents 147, 148 to prevent inadvertent diassembly of the knob from the rose.

When ultimate disassembly is desired, and with the spindle removed, the knob is rotated either clockwise or counterclockwise. In clockwise direction the detent 147, inner sleeve and the projection again mutually yield until the projection reaches the position of FIG. 15. In counterclockwise direction it is the detent 148 sleeve and projection which mutually yield. The knob is then free for removal from the rose. The inside knob, whether for the passage lock or for a lock type modification, is assembled and disassembled from its respective rose in the same fashion and by use of the same structure.

Having described the invention what is claimed as new in support of Letters Patent is as follows:

1. An operating assembly for a door lock comprising a rose member, a knob member having a rotatable retention mounting on the rose member and an axially extending removable spindle, a spindle mounting mass in said knob member having a spindle retaining pocket, a spindle movement clearance space in said rose member in axial alignment with said pocket, an axially outwardly facing shoulder on said mass extending in an arcuate direction, an axially inwardly facing arcuate shoulder on said rose member in a position or rotationally moving retention with said outwardly facing shoulder when in assembled condition, means forming an accommodation space in said rose member diametrically opposite said inwardly facing arcuate shoulder of size greater than said mounting mass for temporary reception of said mounting mass during assembly, and complementary stop means respectively on said rose member and said knob member acting between said rose member and said knob member at limits of rotational movement of said knob member.

2. An operating assembly for a door lock comprising a rose member, a knob member having a rotatable retention mountng on the rose member and an axially extending removable spindle, a spindle mounting mass in said knob member having a spindle retaining pocket, a spindle movement clearance space in said rose member in axial alignment with said pocket, an axially outwardly facing shoulder on said mass extending in an arcuate direction, an axially inwardly facing arcuate shoulder on said rose member in a position of rotationally moving retention with said outwardly facing shoulder when in assembled condition, means forming an accommodation space in said rose member diametrically opposite said inwardly facing arcuate shoulder of size greater than said mounting mass for temporary reception of said mounting mass during assembly, and stop means acting between said rose member and said knob member at limits of rotational movement of said knob member, said stop means being on said rose member and extending into said accommodation space.

3. An operating assembly as in claim 2 wherein said stop means and said mass are mutually yieldable during assembly to enable movement of said mounting mass from said accommodation space to said clearance space during assembly.

4. An operating assembly as in claim 2 wherein said mounting mass is arcuate presenting opposite end edges and said stop means comprises two radially inwardly extending projections located one opposite each of said end edges.

5. An operating assembly as in claim 2 wherein said inwardly facing arcuate shoulder extends no more than substantially 180° and said outwardly facing shoulder extends for less than 180°.

6. An operating assembly as in claim 2 wherein there are mutually rotatable bearing means respectively on the rose member and knob member adjacent said axially inwardly and outwardly facing shoulders for stabilizing the alignment of said knob and rose members.

7. An operating assembly as in claim 4 wherein said radially inwardly extending projections are yieldable and each end of said mass has a deflecting action of said stop means during rotation of the knob in an assembly direction and a stopping action for said knob during rotation in an opposite direction.

* * * * *